US007753141B2

(12) United States Patent
Meyer et al.

(10) Patent No.: US 7,753,141 B2
(45) Date of Patent: Jul. 13, 2010

(54) COILED TUBING DRILLING SYSTEM

(75) Inventors: Timothy Gregory Hamilton Meyer, Highgate Hill (AU); Duncan MacDonald, Ryde (AU)

(73) Assignees: CMTE Development Limited, Pinjarra Hills, Queensland (AU); AJ Lucas Coal Technologies Pty Limited, Ryde, NSW (AU)

( * ) Notice: Subject to any disclaimer, the term of this patent is extended or adjusted under 35 U.S.C. 154(b) by 219 days.

(21) Appl. No.: 11/995,171

(22) PCT Filed: Jul. 20, 2006

(86) PCT No.: PCT/AU2006/001030

§ 371 (c)(1),
(2), (4) Date: Jun. 2, 2008

(87) PCT Pub. No.: WO2007/009189

PCT Pub. Date: Jan. 25, 2007

(65) Prior Publication Data

US 2009/0032307 A1 Feb. 5, 2009

(30) Foreign Application Priority Data

Jul. 20, 2005 (AU) ..... 2005903855

(51) Int. Cl.
*E21B 7/04* (2006.01)
*E21B 19/22* (2006.01)
*E21B 19/08* (2006.01)

(52) U.S. Cl. ..... 175/89; 175/73; 175/103; 175/162; 175/203

(58) Field of Classification Search ..... 175/61, 175/103, 162, 203, 73, 172
See application file for complete search history.

(56) References Cited

U.S. PATENT DOCUMENTS

| | | | | |
|---|---|---|---|---|
| 5,360,075 | A | 11/1994 | Gray | |
| 6,315,052 | B1 * | 11/2001 | Sola | 166/384 |
| 6,536,539 | B2 | 3/2003 | Merecka et al. | |
| 6,799,647 | B2 | 10/2004 | Clemmons | |
| 2005/0236189 | A1 | 10/2005 | Rankin | |
| 2006/0000619 | A1 | 1/2006 | Borst et al. | |

FOREIGN PATENT DOCUMENTS

| | | |
|---|---|---|
| WO | WO2004/035984 | 4/2004 |
| WO | WO2006/014417 | 2/2006 |

OTHER PUBLICATIONS

International Search Report for PCT/AU2006/001030 dated Aug. 25, 2006.

* cited by examiner

*Primary Examiner*—David J Bagnell
*Assistant Examiner*—Catherine Loikith
(74) *Attorney, Agent, or Firm*—Banres & Thornburg LLP

(57) ABSTRACT

A drilling rig for drilling an underground borehole (5) into a seam (4) uses coiled metal tubing (8) fed by a tractor unit (11) from a drum (7) to provide a thrust force to a drilling head. The drilling head has a bent-sub assembly giving an angle of deviation which is controlled by rotating the coiled metal tubing in the borehole by way of rotation of the drum (7) in the frame (12) about the axis of the tube in the borehole (5).

20 Claims, 1 Drawing Sheet

COILED TUBING DRILLING SYSTEM

CROSS REFERENCE TO RELATED APPLICATIONS

This application is the U.S. national phase of PCT/AU2006/001030 filed Jul. 20, 2006. PCT/AU2006/001030 claims the benefit under the Convention of Australian patent application 2005903855 filed Jul. 20, 2005. The complete disclosures of Australian patent application 2005903855 and PCT/AU2006/001030 are hereby incorporated herein by reference.

FIELD OF THE INVENTION

This invention relates to a coiled tubing drilling system and has been devised particularly though not solely for drilling substantially horizontal boreholes in an underground mining situation.

BACKGROUND OF THE INVENTION

There are many instances where it is required to drill horizontal boreholes from an underground drilling rig into a substantially horizontal seam in a mining operation. Such examples include, but are not limited to, the taking of geo samples from underground seams, and gas drainage, e.g. the draining of methane from underground coal seams. These techniques are commonly referred to as "in-seam drilling,".

In-seam drilling is a significant cost component of underground mining, and in particular coal mining, with a high cost of setting up an in-seam drilling rig and high risk associated with the use of a downhole drilling motor and survey tool system.

Present in-seam drilling rigs typically use conventional drill strings with jointed components which is very labour intensive with manual handling of drill pipe and water swivel connections typically required for every three meters drilled. The normal operational crew of existing in-seam drilling systems is typically three people per shift and there are significant risk and cost benefits to be gained by reducing the general underground population and simplifying the drilling rigs used in this situation.

The use of coiled tubing which comprises a relatively thin walled strip of sheet metal coiled and edge-welded into a continuous tube which is able to transmit a longitudinal thrust force while being flexible enough to be wound onto a drum or passed around a bend has been known in drilling operations for some time. Coiled tubing operations were originally developed for workovers (treatment, re-stimulation, and maintenance) of existing oil and gas wells. The continuous roll of tubing allowed for rapid insertion and retraction of downhole tools, and enabled these operations to be completed without the need for a conventional workover rig. Coiled tubing drilling (CTD) has been in use for some time, typically for the placement of substantially vertical, slim hole wells (typically gas wells), although CTD technology has more recently been used for deep directional and horizontal wells. It is however typically difficult to control the direction of the drilling head in a CTD rig and the present invention addresses this problem in a manner which allows for cost effective and accurate deployment of a CTD drilling rig in an underground mining situation.

As an alternative to coiled tubing, it is also known to use composite tubing, and these alternatives are generically described as semi-rigid tubing in this specification.

SUMMARY OF THE INVENTION

Accordingly, the present invention provides a drilling rig for drilling underground boreholes, the rig including a length of semi-rigid tubing wound onto a drum rotatably mounted in a drum frame and arranged such that the semi-rigid tubing can be unwound from the drum and deployed through an injector unit into a borehole, the drum frame being rotatably mounted in turn in a support cradle such that the frame is controllably rotatable about an axis perpendicular to the axis of rotation of the drum and parallel to or substantially coincident with the axis of the semi-rigid tubing deployed through the injector unit;

the rig further including a drilling assembly mounted on the end of the semi-rigid tubing and incorporating an offset feature causing the drilling assembly to deviate from a straight path as the semi-rigid tubing is advanced by the injector unit during drilling operations, whereby the direction of deviation is controlled by rotating the semi-rigid tubing about its longitudinal axis effected by rotating the drum frame relative to the support cradle.

Preferably, the injector unit comprises a tractor unit providing a thrust force to the tubing, thereby pushing the tubing and attached drilling assembly into the borehole during drilling.

Preferably, the injector unit is also operable to apply a tension force to the tubing, thereby retracting the tubing and drilling assembly from the hole when required.

Preferably, the drilling assembly includes a conventional downhole motor.

Preferably, the downhole motor is arranged to drive a PCD drill bit and the drilling assembly also includes a survey and geo-sensing package.

Preferably, the offset feature comprises a bent-sub housing arranged such that the axis of the drill bit is offset from the longitudinal axis of the tubing in the borehole.

Preferably the semi-rigid tubing is deployed into the borehole through a peripheral seal, allowing borehole fluid to be constantly pressurised during drilling operations.

BRIEF DESCRIPTION OF THE DRAWINGS

Notwithstanding any other forms that may fall within its scope, one preferred form of the invention will now be described by way of example only with reference to the accompanying drawings in which.

DETAILED DESCRIPTION OF THE PREFERRED EMBODIMENT OF THE INVENTION

Figure 1:
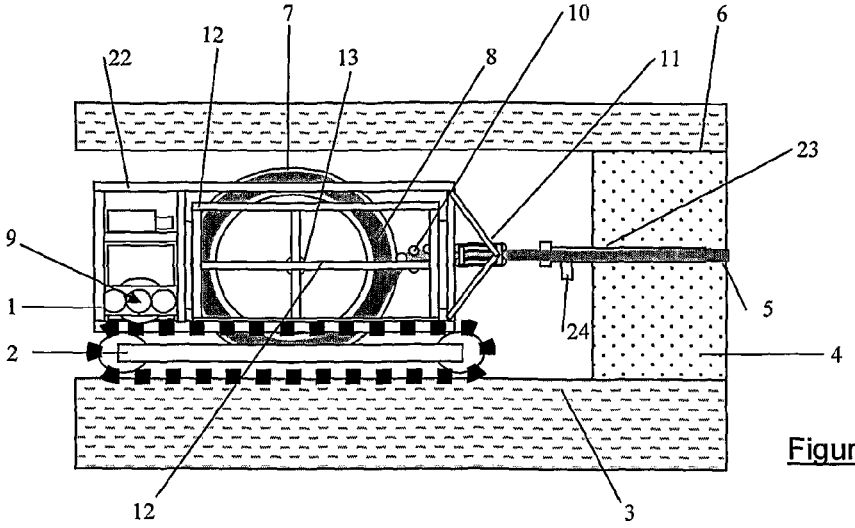
FIG. 1 is a diagrammatic elevation of a drilling rig according to the invention located in an underground seam drilling situation.
Figure 2:
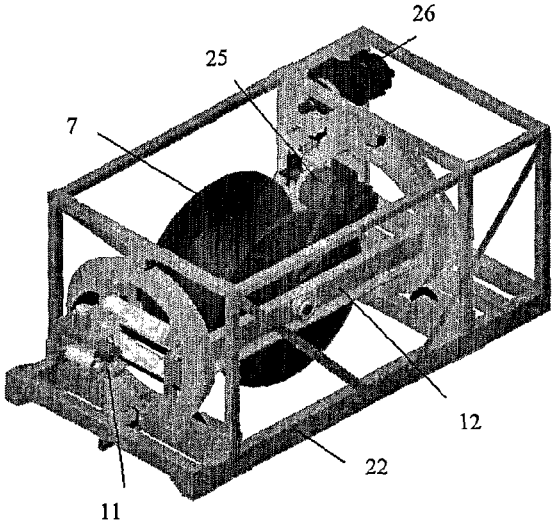
FIG. 2 is a perspective view of a rig similar to that shown in FIG. 1, demonstrating the arrangement of the drum frame and support cradle.

The CTD (coiled tubing drilling) system according to the invention is a track mounted, highly mobile drilling unit. The unit typically comprises a drilling unit 1 mounted on a drive track unit 2 for mobile deployment within a mining situation which might typically include a mine road having a floor 3 located adjacent to a seam 4 where it is desired to drill a substantially horizontal borehole 5. The roof of the roadway is shown at 6.

A drum 7 mounted on the drilling unit 1 houses the coiled tubing 8 wound onto the drum. An hydraulic motor 25 rotates the drum to feed tubing on and off the drum as required. Hydraulic power to turn the motor is supplied by an electrically powered hydraulic power pack either located on the drilling unit as shown at 9 or nearby on a separate skid.

The coiled tubing 8 feeds off the drum through a tubing straightener and/or tensioner unit 10 and through an injector (tractor) unit 11. The injector unit 11 provides a thrust force to the tubing, thereby pushing the tubing and attached downhole assembly (to be described further below) into the borehole 5 during drilling. The injector unit 11 is also capable of applying a tension force to the tubing thereby retracting the tubing and downhole assembly from the hole when required.

The tubing drum 7 is mounted within a frame 12 which can rotate about an axis perpendicular to the drum rotation axis 13 and parallel to or co-incident with the axis of the injector unit 11 and initial drilling direction as typified by borehole 5. Rotation of the drum frame about this axis effected by drive motor 26 causes the tubing to rotate within the borehole 5, thereby allowing control of the orientation (clock face) of the downhole assembly as described below.

The downhole assembly consists of a conventional downhole motor 14 driving a PCD drill bit 15, a bent sub-housing 16 and a survey and geo-sensing electronics compartment 17 connected to the downhole motor by a survey geo-sensing connection sub 18 and a pump off sub 19.

The downhole assembly is typically completed by a BHA sub 20 connected to the end of the coiled tubing 21.

Appropriate sections of non-magnetic rod can be used either side of the survey assembly to minimise distortion of the earth's magnetic field caused by the DHM and coiled tubing.

An electrical multi-coil wire line is typically inserted through the entire length of tubing, connecting the downhole survey and geo-sensing package to an up hole display and data logging system (not shown) thereby enabling continuous real-time data streaming between the downhole and up hole assemblies.

The survey system can take measurements of the inclination, azimuth and tool face (pitch, yaw and roll) of the downhole assembly. This data, combined with distance data obtained from an encoder on the drum 7 measuring the amount of tubing fed into the borehole 5, enables dead reckoning calculation of the borehole trajectory.

The bent sub section 16 provides an offset feature causing the drilling assembly to deviate from a straight path with the direction of deviation controlled by rotating the coiled tubing 8 about its longitudinal axis by rotating the drum frame 12 relative to the support cradle 22. In this manner, the direction of deviation of the drilling head can be accurately controlled from the drilling rig 1.

Figure 3:
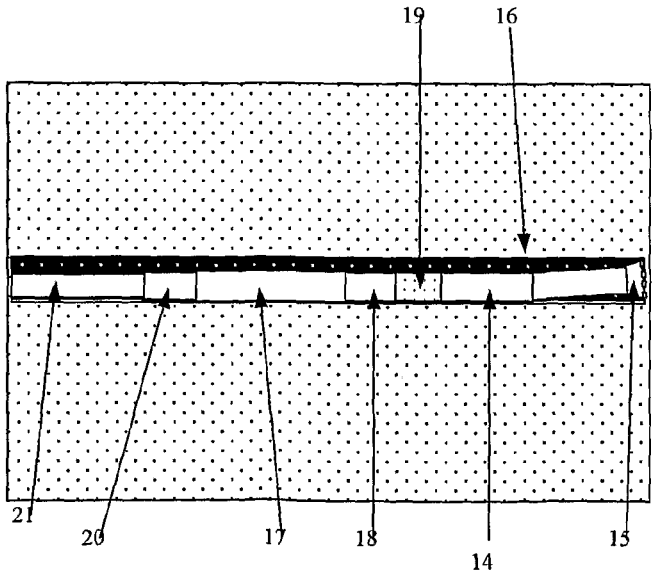
FIG. 3 is an elevation through an underground borehole drilled by the apparatus according to the invention showing the drilling assembly in operation at the end of the borehole.

Drilling operations can be made in one of two modes; rotating, for drilling relatively straight sections of hole; and sliding, for making changes to the borehole trajectory. In rotating mode, the drum frame 12 is rotated about its axis (co-incident with the axis of tractor unit 11) at a steady rate, typically up to 10 r.p.m. This imparts a rotation to the coiled tubing 8, 21 and the downhole assembly shown in FIG. 3 at the same rate.

Meanwhile, the rig pump (not shown) is supplying pressurized drilling fluid, generally water, to the downhole motor 14 through the coiled tubing 8, thereby causing the drill bit to rotate at around 350 r.p.m. The drill string is advanced into the formation by means of the thrust force provided to the tubing 8 by the injector unit 11. In this manner the borehole is advanced into the seam 4 at a steady rate and in a generally straight direction.

When a correction or change to the current borehole trajectory is desired, rotation of the drum frame 12 is stopped, and the drilling mode changes to sliding. In sliding mode, the drum frame is orientated at an axial position which causes the downhole assembly (and particularly the bent sub component 16) to assume a particular face angle. The effect of the bent sub on the drill trajectory is that it causes the drill to create a curved hole, the hole turning towards the inner angle prescribed by the longitudinal axes of the sub and downhole motor sections. In this manner the trajectory of the borehole can be controlled by the operator appropriately orientating the bent sub housing by rotating the drum frame 12 about its axis to the desired position.

In order to facilitate the operation of the rig, the unit 1 is positioned close to the face of the seam 4 which has previously had a standpipe 23 installed for a short distance into the seam and grouted in place to form a stable, water-tight secured entrance point for the borehole. The standpipe has a T-piece pipe 24 which is the exit point of waste water and cuttings from the borehole. A stripper rubber assembly at the end of the standpipe provides a water-tight seal between the tubing and the standpipe, allowing the tubing to move into and out of the standpipe whilst the borehole fluid is pressurized.

An issue associated with conventional, segmented rod drilling from roadways into virgin coal conditions is collapse of the borehole wall around the drill string, causing the string to become stuck and potential loss of the downhole equipment. This issue is commonly caused by drilling "underbalanced", whereby the borehole fluid pressure is significantly lower than the formation pressure, into highly stressed and/or weakened zones within the coal. A significant advantage of the coiled tubing drilling system is that the continuous length of tubing passing through a peripheral seal in the form of stripper rubber in the standpipe allows for the borehole fluid to be constantly pressurised during drilling operations and when running the bottom hole assembly into and out of the borehole. The higher borehole fluid pressure helps support the borehole wall, hence makes it less prone to collapse. Maintaining borehole pressurisation with segmented rods is very difficult due to the need to disconnect the rod string from the supply pump every time a rod needs to be added or removed from the string.

In this manner a relatively simple drilling system which is fast and simple to operate using reduced manpower can be deployed in an underground situation for the cost effective drilling of underground boreholes.

The coiled tubing drilling system offers further benefits over conventional drilling systems in that a faster drilling rate per shift is achieved because there are no rod connections, and therefore a continuous drilling procedure.

Because there is no rod handling required, less personnel are needed to undertake drilling and retraction functions.

The coiled tubing drilling system utilises tried and tested conventional downhole motor (DHM) technology.

Continuous coiled tubing length allows wire line connection between rig and downhole survey gear, therefore cheaper downhole component costs while providing high data transfer rates.

Continuous drilling system (with no rod changes) facilitates integration of potential borehole pressurization system, which will benefit drilling through "soft" coal zones.

The invention claimed is:

1. A drilling rig for drilling underground boreholes, the rig including a length of semi-rigid tubing wound onto a drum rotatably mounted in a drum frame and arranged such that the semi-rigid tubing can be unwound from the drum and deployed through an injector unit into a borehole, the drum frame being rotatably mounted in turn in a support cradle such that the frame is controllably rotatable about an axis perpendicular to the axis of rotation of the drum and parallel to the axis of the semi-rigid tubing deployed through the injector unit; the semi-rigid tubing being deployed into the borehole through a peripheral seal, allowing borehole fluid to be constantly pressurized during drilling operations; the rig further including a drilling assembly mounted on the end of the semi-rigid tubing and incorporating an offset feature causing the drilling assembly to deviate from a straight path as the semi-rigid tubing is advanced by the injector unit during drilling operations, whereby the direction of deviation is controlled by rotating the semi-rigid tubing about its longitudinal axis effected by rotating the drum frame relative to the support cradle.

2. A drilling rig as claimed in claim 1 wherein the injector unit comprises a tractor unit providing a thrust force to the tubing, thereby pushing the tubing and attached drilling assembly into the borehole during drilling.

3. A drilling rig as claimed in claim 2 wherein the injector unit is also operable to apply a tension force to the tubing, thereby retracting the tubing and drilling assembly from the hole when required.

4. A drilling rig as claimed in claim 3 wherein the drilling assembly includes a downhole motor.

5. A drilling rig as claimed in claim 3 wherein the offset feature comprises a bent-sub housing arranged such that the axis of the drill bit is offset from the longitudinal axis of the coiled tubing in the borehole.

6. A drilling rig as claimed in claim 2 wherein the drilling assembly includes a downhole motor.

7. A drilling rig as claimed in claim 2 wherein the offset feature comprises a bent-sub housing arranged such that the axis of the drill bit is offset from the longitudinal axis of the coiled tubing in the borehole.

8. A drilling rig as claimed in claim 1 wherein the drilling assembly includes a downhole motor.

9. A drilling rig as claimed in claim 8 wherein the offset feature comprises a bent-sub housing arranged such that the axis of the drill bit is offset from the longitudinal axis of the coiled tubing in the borehole.

10. A drilling rig as claimed in claim 1 wherein the offset feature comprises a bent-sub housing arranged such that the axis of the drill bit is offset from the longitudinal axis of the coiled tubing in the borehole.

11. A drilling rig for drilling underground boreholes, the rig including a length of semi-rigid tubing wound onto a drum rotatably mounted in a drum frame and arranged such that the semi-rigid tubing can be unwound from the drum and deployed through an injector unit into a borehole, the drum frame being rotatably mounted in turn in a support cradle such that the frame is controllably rotatable about an axis perpendicular to the axis of rotation of the drum and substantially coincident with the axis of the semi-rigid tubing deployed through the injector unit; the semi-rigid tubing being deployed into the borehole through a peripheral seal, allowing borehole fluid to be constantly pressurized during drilling operations; the rig further including a drilling assembly mounted on the end of the semi-rigid tubing and incorporating an offset feature causing the drilling assembly to deviate from a straight path as the semi-rigid tubing is advanced by the injector unit during drilling operations, whereby the direction of deviation is controlled by rotating the semi-rigid tubing about its longitudinal axis effected by rotating the drum frame relative to the support cradle.

12. A drilling rig as claimed in claim 11 wherein the injector unit comprises a tractor unit providing a thrust force to the tubing, thereby pushing the tubing and attached drilling assembly into the borehole during drilling.

13. A drilling rig as claimed in claim 12 wherein the injector unit is also operable to apply a tension force to the tubing, thereby retracting the tubing and drilling assembly from the hole when required.

14. A drilling rig as claimed in claim 13 wherein the drilling assembly includes a downhole motor.

15. A drilling rig as claimed in claim 13 wherein the offset feature comprises a bent-sub housing arranged such that the axis of the drill bit is offset from the longitudinal axis of the coiled tubing in the borehole.

16. A drilling rig as claimed in claim 12 wherein the drilling assembly includes a downhole motor.

17. A drilling rig as claimed in claim 12 wherein the offset feature comprises a bent-sub housing arranged such that the axis of the drill bit is offset from the longitudinal axis of the coiled tubing in the borehole.

18. A drilling rig as claimed in claim 11 wherein the drilling assembly includes a downhole motor.

19. A drilling rig as claimed in claim 18 wherein the offset feature comprises a bent-sub housing arranged such that the axis of the drill bit is offset from the longitudinal axis of the coiled tubing in the borehole.

20. A drilling rig as claimed in claim 11 wherein the offset feature comprises a bent-sub housing arranged such that the axis of the drill bit is offset from the longitudinal axis of the coiled tubing in the borehole.

* * * * *